US011519436B2

(12) United States Patent
Corallo et al.

(10) Patent No.: US 11,519,436 B2
(45) Date of Patent: Dec. 6, 2022

(54) SERVICEABLE LAMINAR FLOW ELEMENT

(71) Applicant: Hamilton Sundstrand Corporation, Charlotte, NC (US)

(72) Inventors: Roger Corallo, West Suffield, CT (US); Cory R. Rice, Simsbury, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 16 days.

(21) Appl. No.: 17/160,907

(22) Filed: Jan. 28, 2021

(65) Prior Publication Data

US 2021/0301845 A1 Sep. 30, 2021

Related U.S. Application Data

(60) Provisional application No. 63/002,647, filed on Mar. 31, 2020.

(51) Int. Cl.
*F15D 1/02* (2006.01)

(52) U.S. Cl.
CPC ..... *F15D 1/025* (2013.01)

(58) Field of Classification Search
CPC ..... F15D 1/025; F22B 37/74
USPC ..... 138/44
See application file for complete search history.

(56) References Cited

U.S. PATENT DOCUMENTS

| | | | | | |
|---|---|---|---|---|---|
| 3,995,356 | A * | 12/1976 | Sheppard | F01N 3/22 | 138/40 |
| 4,106,525 | A * | 8/1978 | Currie | F16L 55/02772 | 138/44 |
| 4,431,030 | A * | 2/1984 | Nachazel | G04F 1/06 | 92/143 |
| 4,808,154 | A * | 2/1989 | Freeman | A61M 1/85 | 604/22 |
| 5,468,057 | A * | 11/1995 | Megerle | B60T 8/42 | 138/44 |
| 5,511,416 | A | 4/1996 | Shambayati | | |
| 5,576,498 | A | 11/1996 | Shambayati | | |
| 5,824,894 | A | 10/1998 | Lucas et al. | | |
| 5,837,903 | A | 11/1998 | Weigand | | |
| 7,992,454 | B2 | 8/2011 | Purdy et al. | | |
| 8,281,817 | B2 * | 10/2012 | Tinker | F16L 55/02772 | 366/175.2 |
| 8,573,247 | B2 * | 11/2013 | Ushigusa | G05D 7/0647 | 138/44 |
| 9,249,915 | B2 * | 2/2016 | Rogers | F16L 55/027 | |
| 9,348,344 | B2 * | 5/2016 | Le | G05D 7/012 | |
| 9,354,095 | B2 | 5/2016 | Sorenson et al. | | |
| 10,295,100 | B1 * | 5/2019 | Handley | F16K 3/03 | |

(Continued)

*Primary Examiner* — Craig M Schneider
*Assistant Examiner* — David R Deal
(74) *Attorney, Agent, or Firm* — Cantor Colburn LLP

(57) ABSTRACT

Serviceable laminar flow elements are described. The serviceable laminar flow elements includes a flow sleeve, a laminar flow rod installed within the flow sleeve, a mounting plug arranged at a first end of the flow sleeve configured to fixedly secure the laminar flow rod within the flow sleeve at the first end, and an index cap arranged at a second end of the flow sleeve configured to fixedly secure the laminar flow rod within the flow sleeve at the second end. A laminar flow path is defined by a gap between an interior surface of the flow sleeve and an exterior surface of the laminar flow rod.

19 Claims, 7 Drawing Sheets

(56) References Cited

U.S. PATENT DOCUMENTS

2020/0325999 A1* 10/2020 Aklog ..... A61M 5/14
2021/0293260 A1* 9/2021 Wu ..... F15D 1/065

* cited by examiner

SERVICEABLE LAMINAR FLOW ELEMENT

CROSS-REFERENCE TO RELATED APPLICATIONS

This application claims the benefit of U.S. Provisional Application Ser. No. 63/002,647 filed Mar. 31, 2020, the disclosure of which is incorporated herein by reference in its entirety.

STATEMENT REGARDING FEDERALLY SPONSORED RESEARCH OR DEVELOPMENT

This invention was made with government support under NNJ14GA09B awarded by NASA. The government has certain rights in the invention.

BACKGROUND

The subject matter disclosed herein generally relates to laminar flow elements and systems, and more specifically to serviceable or changeable laminar flow elements and systems that employ serviceable laminar flow elements.

Laminar flow elements have many uses in many diverse industries. For example, laminar flow elements may be employed for processing water in extreme conditions, such as on board spacecraft. Such laminar flow elements may be high precision structures that provide for a fine mixture control of fluids (e.g., gas) in gas-to-water systems or recovery systems. Because of the nature of such recovery systems, high precision is necessary to ensure functionality and efficiency. However, due to the high precision nature of these devices and systems contamination and/or damage may reduce or eliminate the functionality of such devices/systems. Additionally, due to the high precision nature of these devices and systems, performing maintenance and/or repairs may be difficult or impossible (e.g., onboard a spacecraft). Accordingly, it may be advantageous to improve the serviceability of high precision laminar flow elements.

BRIEF SUMMARY

According to some embodiments, serviceable laminar flow elements are provided. The serviceable laminar flow elements include a flow sleeve, a laminar flow rod installed within the flow sleeve, a mounting plug arranged at a first end of the flow sleeve configured to fixedly secure the laminar flow rod within the flow sleeve at the first end, and an index cap arranged at a second end of the flow sleeve configured to fixedly secure the laminar flow rod within the flow sleeve at the second end. A laminar flow path is defined by a gap between an interior surface of the flow sleeve and an exterior surface of the laminar flow rod.

In addition to one or more of the features described above, or as an alternative, further embodiments of the serviceable laminar flow elements may include a fastener configured to securely attach the index cap to the laminar flow rod.

In addition to one or more of the features described above, or as an alternative, further embodiments of the serviceable laminar flow elements may include that the index cap comprises a locking protrusion configured to engage with a locking slot of the flow sleeve such that relative rotation between the flow sleeve and the laminar flow rod is prevented.

In addition to one or more of the features described above, or as an alternative, further embodiments of the serviceable laminar flow elements may include that the gap is between about 0.0001 inches to about 0.0010 inches.

In addition to one or more of the features described above, or as an alternative, further embodiments of the serviceable laminar flow elements may include that the gap is about 0.0005 inches.

In addition to one or more of the features described above, or as an alternative, further embodiments of the serviceable laminar flow elements may include that the flow sleeve comprises at least one first aperture at the first end to receive a fluid therethrough and at least one second aperture at the second end to allow a fluid to pass therethrough.

In addition to one or more of the features described above, or as an alternative, further embodiments of the serviceable laminar flow elements may include at least one seal configured to sealingly engage between the interior surface of the flow sleeve and the exterior surface of the laminar flow rod.

In addition to one or more of the features described above, or as an alternative, further embodiments of the serviceable laminar flow elements may include that the gap is substantially constant along the laminar flow path.

According to some embodiments, fluid processing systems are provided. The fluid processing systems include a manifold assembly defining a laminar element bore and a serviceable laminar flow element installed within the laminar element bore. The serviceable laminar flow element includes a flow sleeve, a laminar flow rod installed within the flow sleeve, a mounting plug arranged at a first end of the flow sleeve configured to fixedly secure the laminar flow rod within the flow sleeve at the first end, and an index cap arranged at a second end of the flow sleeve configured to fixedly secure the laminar flow rod within the flow sleeve at the second end. A laminar flow path is defined by a gap between an interior surface of the flow sleeve and an exterior surface of the laminar flow rod.

In addition to one or more of the features described above, or as an alternative, further embodiments of the fluid processing systems may include a fastener configured to securely attach the index cap to the laminar flow rod.

In addition to one or more of the features described above, or as an alternative, further embodiments of the fluid processing systems may include that the index cap comprises a locking protrusion configured to engage with a locking slot of the flow sleeve such that relative rotation between the flow sleeve and the laminar flow rod is prevented.

In addition to one or more of the features described above, or as an alternative, further embodiments of the fluid processing systems may include that the gap is between about 0.0001 inches to about 0.0010 inches.

In addition to one or more of the features described above, or as an alternative, further embodiments of the fluid processing systems may include that the gap is about 0.0005 inches.

In addition to one or more of the features described above, or as an alternative, further embodiments of the fluid processing systems may include that the flow sleeve comprises at least one first aperture at the first end to receive a fluid therethrough and at least one second aperture at the second end to allow a fluid to pass therethrough.

In addition to one or more of the features described above, or as an alternative, further embodiments of the fluid processing systems may include at least one seal configured to sealingly engage between the interior surface of the flow sleeve and the exterior surface of the laminar flow rod.

In addition to one or more of the features described above, or as an alternative, further embodiments of the fluid processing systems may include that the gap is substantially constant along the laminar flow path.

In addition to one or more of the features described above, or as an alternative, further embodiments of the fluid processing systems may include that the fluid processing system is configured to generate water from carbon dioxide and hydrogen.

In addition to one or more of the features described above, or as an alternative, further embodiments of the fluid processing systems may include a mounting seal arranged along the laminar element bore and configured to form a seal between the laminar element bore and an exterior surface of the flow sleeve.

In addition to one or more of the features described above, or as an alternative, further embodiments of the fluid processing systems may include that the mounting plug is configured to fixedly attach the serviceable laminar flow element to the manifold assembly.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

Figure 6B:
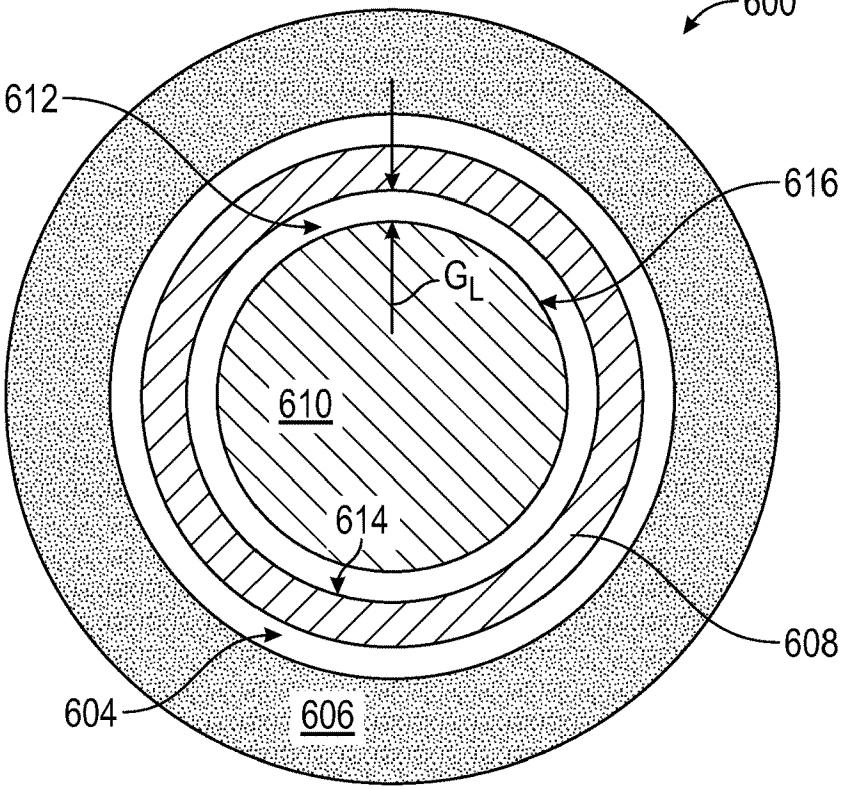
Figure 6A:
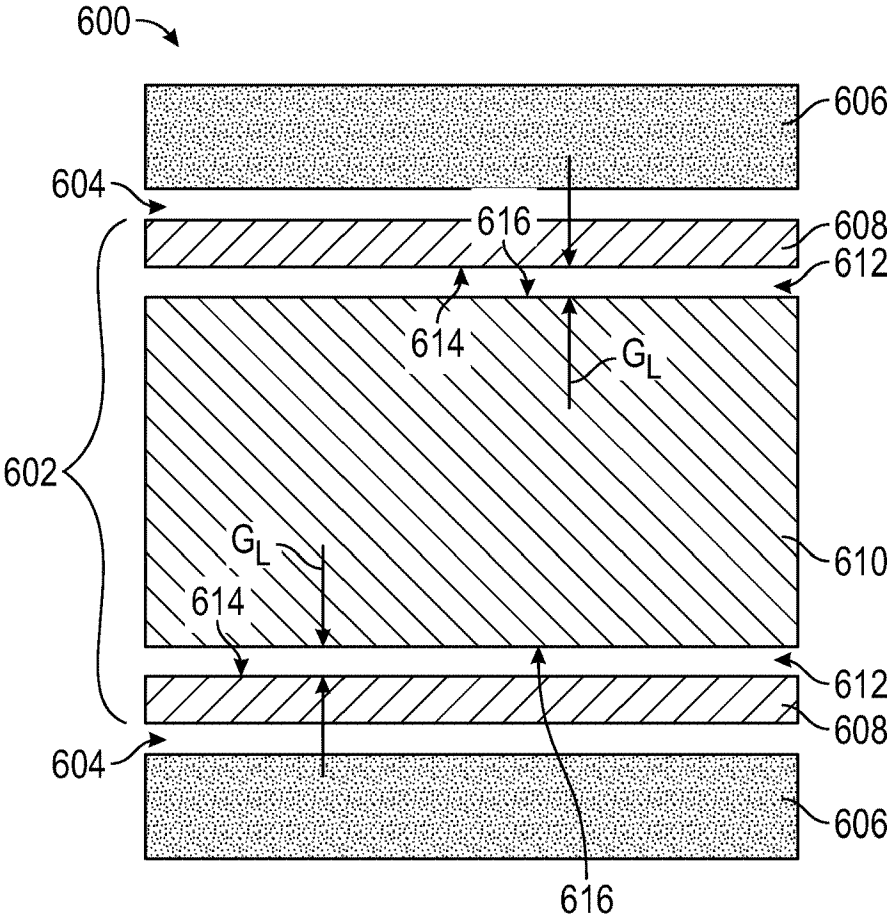
Figure 7A:
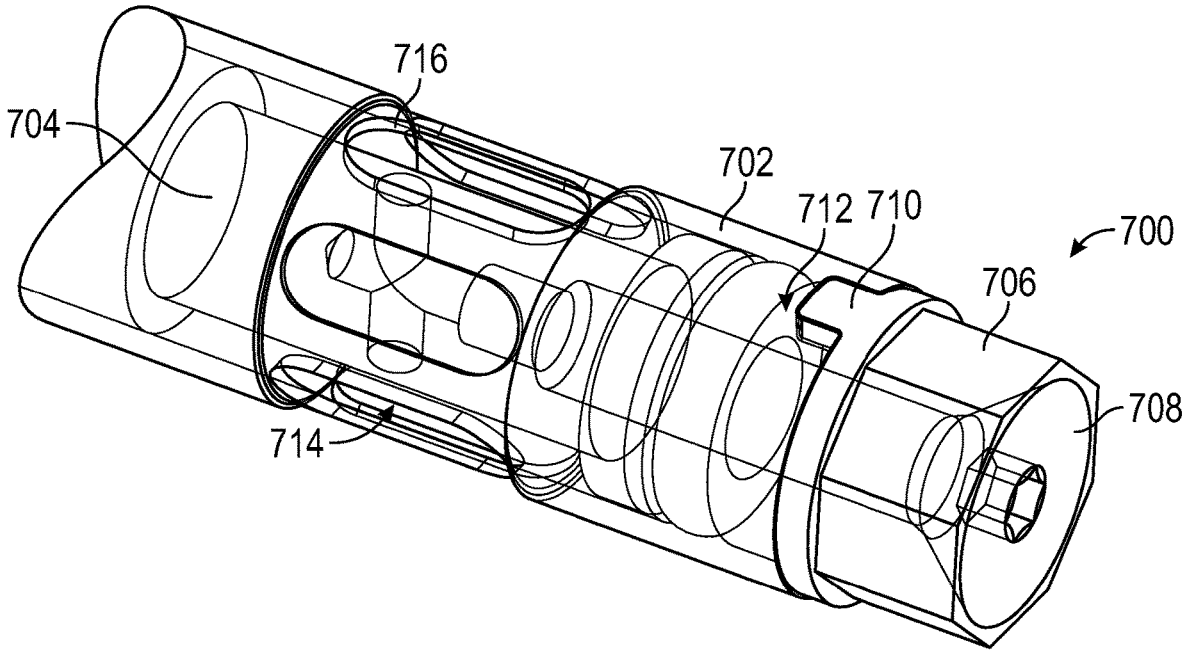
Figure 7B:
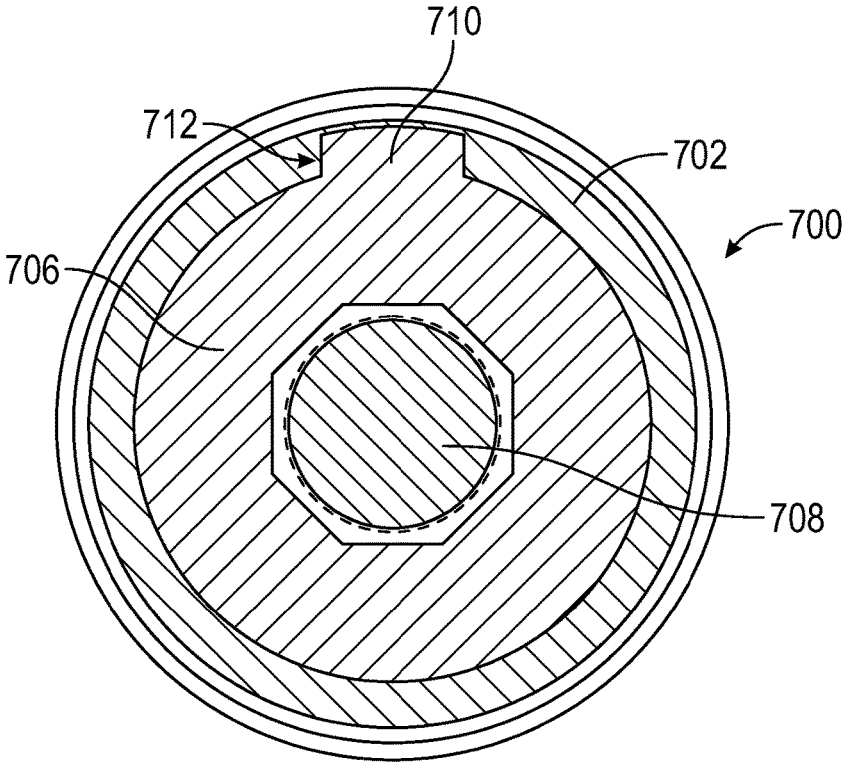

FIG. 6A FIG. illustrates a side elevation cross-sectional view of a portion of a fluid processing system in accordance with an embodiment of the present disclosure;

FIG. 6B illustrates a front or axial cross-sectional view of the fluid processing system of FIG. 6A;

FIG. 7A illustrates a portion of a serviceable laminar flow element in accordance with an embodiment of the present disclosure; and FIG. 7B illustrates an end-on elevation view of the serviceable laminar flow element of FIG. 7A.

DETAILED DESCRIPTION

A detailed description of one or more embodiments of the disclosed apparatus and method are presented herein by way of exemplification and not limitation with reference to the Figures.

Figure 1:
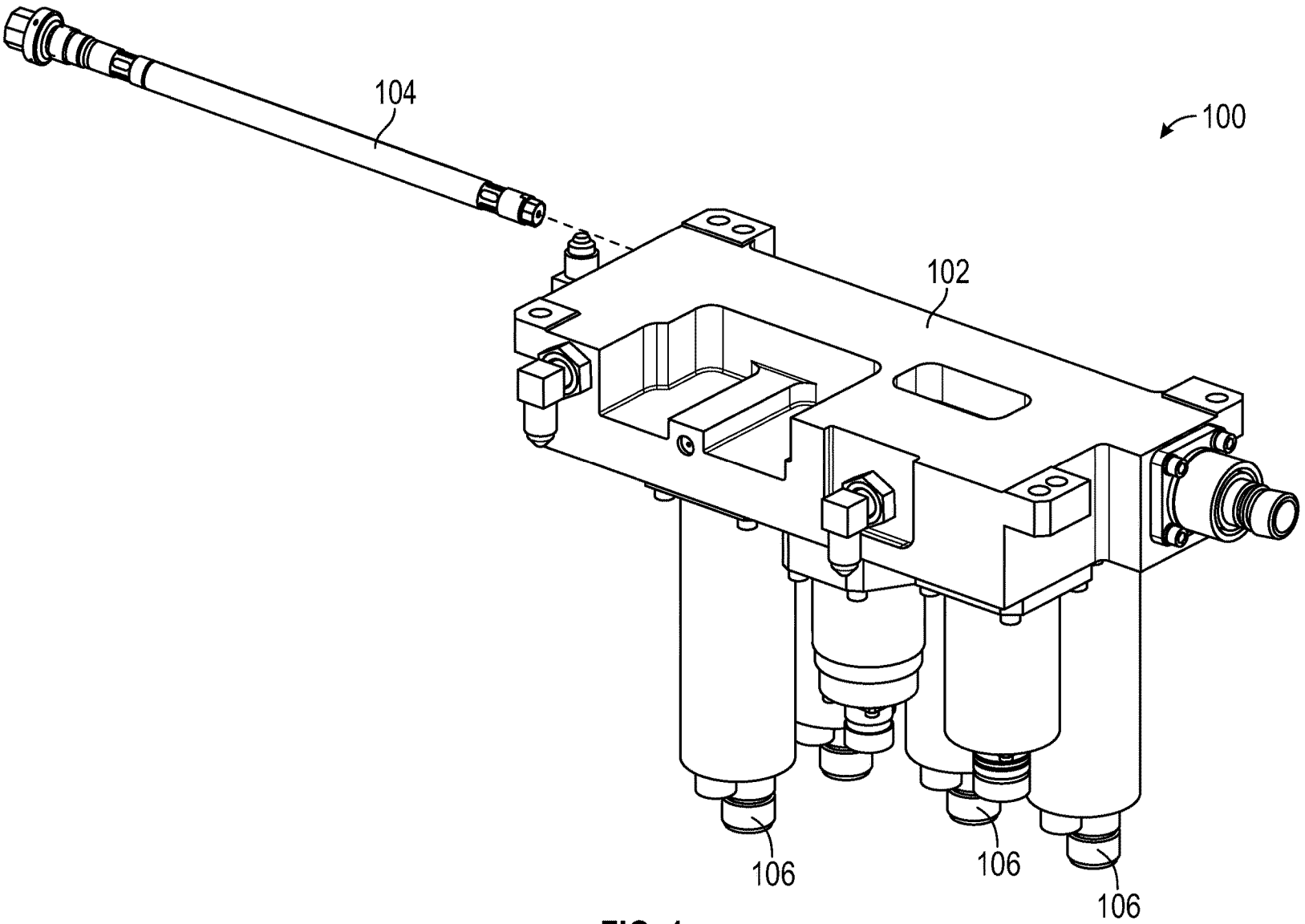
FIG. 1 is a schematic illustration of a fluid processing system in accordance with an embodiment of the present disclosure.

Referring to FIG. 1, a schematic illustration of a fluid processing system 100 in accordance with an embodiment of the present disclosure is shown. The fluid processing system 100 includes a manifold assembly 102 (e.g., reactor manifold) and a serviceable laminar flow element 104. The manifold assembly 102 is configured to control and distribute system working fluids. For example, the fluid processing system 100 may be used onboard spacecraft for the purpose of extracting water from gas and other fluid inputs. In one or more configurations, the fluid processing system 100 may be configured to convert waste carbon dioxide and hydrogen to provide needed water for a closed-loop life-support system onboard a spacecraft (e.g., Sabatier reaction).

Processing of different gases for the purpose of carrying out the Sabatier reaction to enable formation of water from gases, such as carbon dioxide and hydrogen, typically requires laminar flow of the fluids to ensure an efficient processing capability. As shown, the manifold assembly 102 receives one or more reactor elements 106 and the serviceable laminar flow element 104. As noted, laminar flow may be required to ensure efficient water generation. Accordingly, ensuring that the serviceable laminar flow element 104 continuously provides a high precision control of laminar flow is necessary. To achieve this, the serviceable laminar flow element 104 may be a high-precision element that is manufactured to very specific requirements. However, if a flow path within or along the serviceable laminar flow element 104 becomes contaminated, the efficiency may be reduced and/or the generation of water may be significantly impacted.

In prior configurations, particularly for space-based systems, the laminar flow element was manufactured within a high-precision laboratory to be made within very specific tolerances. The manufactured laminar flow element would then be assembled on Earth, and the entire fluid processing system 100 would be assembly and installed onboard a spacecraft. A laminar flow path would be defined between an exterior surface of a laminar flow rod and an interior surface of a laminar flow bore of a manifold into which the laminar flow rod is installed. As such, both the exterior surface of the laminar flow rod and the interior surface of the laminar flow bore must be manufactured to high precision. Such high precision manufacturing will ensure laminar flow through a flow path between the exterior surface of the laminar flow rod and the interior surface of the laminar flow bore. However, once in space, if any issues arise, due to the high precision of the component and the nature of the assembly, the fluid processing system 100 was very difficult or impossible to repair or perform maintenance thereon. In view of this, embodiments of the present disclosure are directed to a serviceable laminar flow element that allows for repair, replacement, and/or maintenance to be performed thereon, even onboard a spacecraft.

As shown in FIG. 1, the serviceable laminar flow element 104 may be a component that can be installed into the manifold assembly 102. The serviceable laminar flow element 104, as shown and described below, is configured to be removably installed into the manifold assembly 102. This enables the ability to manufacture just a replacement laminar flow element without the need to rebuild or assemble an entirely new fluid processing system 100.

Figure 2A:
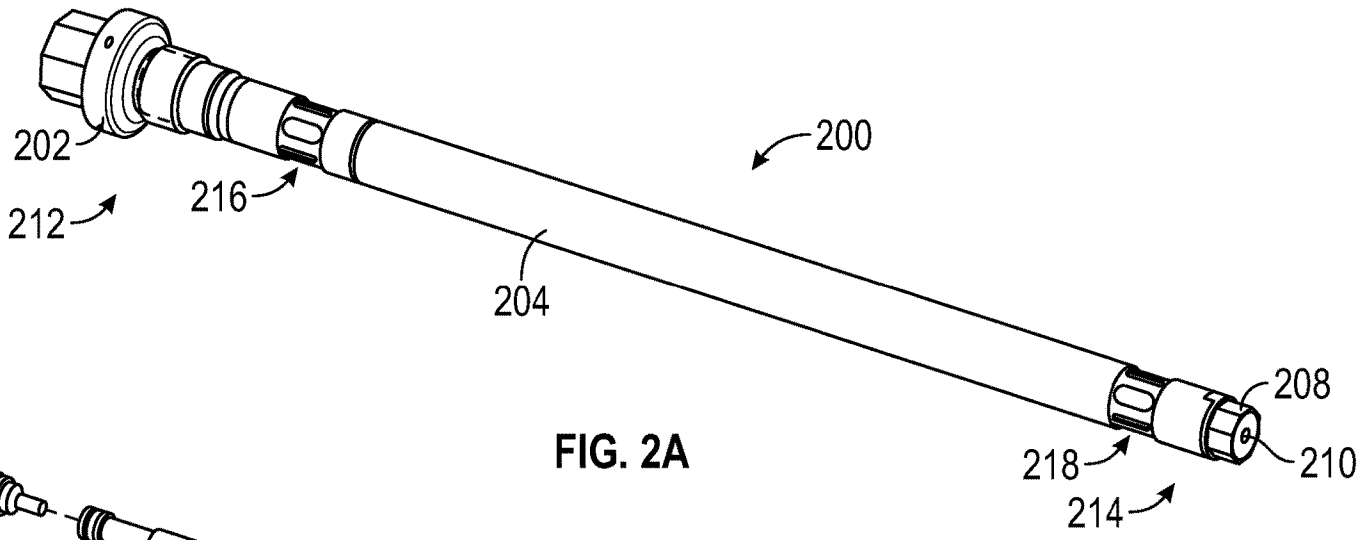
FIG. 2A is a schematic illustration of a serviceable laminar flow element in accordance with an embodiment of the present disclosure.
Figure 2B:
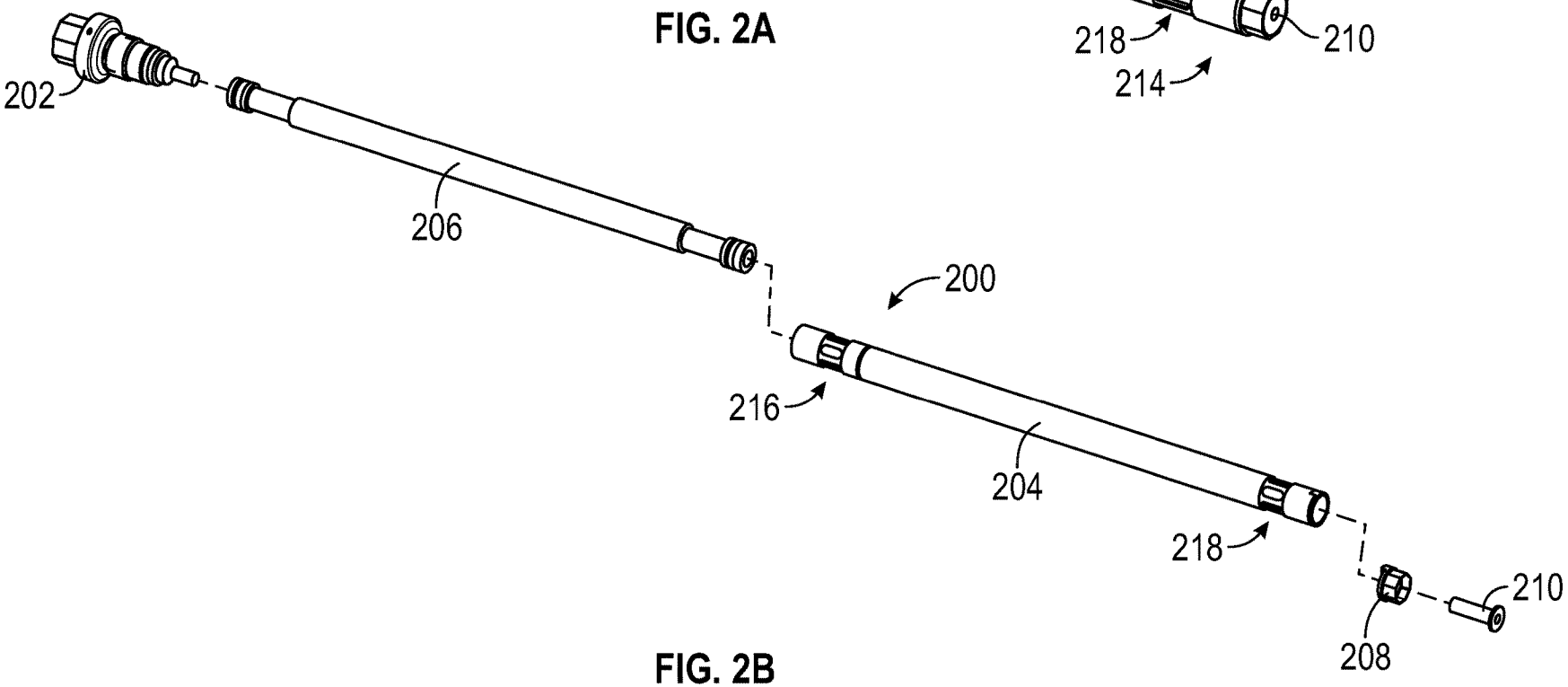
FIG. 2B is a schematic exploded illustration of the serviceable laminar flow element of FIG. 2A.

Turning now to FIGS. 2A-2B, schematic illustrations of a serviceable laminar flow element 200 in accordance with an embodiment of the present disclosure are shown. The serviceable laminar flow element 200 may be configured to be removably installed into a manifold assembly of a fluid processing system, such as shown and described above. The serviceable laminar flow element 200 includes a mounting plug 202, a flow sleeve 204, a laminar flow rod 206, an index cap 208, and a fastener 210. FIG. 2A illustrates the serviceable laminar flow element 200 as assembled and ready to be installed within a manifold assembly and FIG. 2B illustrates the serviceable laminar flow element 200 in an exploded or separated view.

To assemble the serviceable laminar flow element 200, the laminar flow rod 206 is installed within the flow sleeve 204. The mounting plug 202 and the combination of the index cap 208 and the fastener 210 provide for fixed installation, positioning, and orientation of the laminar flow rod 206 within the flow sleeve 204. When assembled, the serviceable laminar flow element 200 can then be installed into and attached to a manifold assembly of a fluid processing system. For operation, the serviceable laminar flow element 200 can receive a fluid at a first end 212, pass the fluid from the first end 212 to a second end 214 in a laminar flow, and supply the laminar flow of fluid out at the second end 214. Accordingly, as shown, the serviceable laminar flow element 200 includes one or more first apertures 216 at the first end 212 and one or more second apertures 218 at the second end 214. The first apertures 216 can receive a fluid and direct such fluid to a laminar flow path defined by an interior of the flow sleeve 204 and an exterior of the laminar flow rod 206. The gap or space between the interior of the flow sleeve 204 and the exterior of the laminar flow rod 206 may be precisely set (e.g., with high precision) to ensure a laminar flow is formed and generated as the fluid flows from the first apertures 216 (e.g., inlet) to the second apertures 218 (e.g., outlet) of the serviceable laminar flow element 200.

The index cap 208 may be configured to prevent relative movement (e.g., rotation) of the laminar flow rod 206 relative to the flow sleeve 204. That is, the index cap 208 can lock the relative position of the laminar flow rod 206 relative to the flow sleeve 204. This can be achieved through a slot-and-key arrangement, as described herein.

The mounting plug 202 may be configured to fixedly connect to at least one of the laminar flow rod 206 and the flow sleeve 204. The mounting plug 202 is configured to fixedly install and retain the assembled serviceable laminar flow element 200 within a manifold assembly of a fluid processing system.

Figure 3:
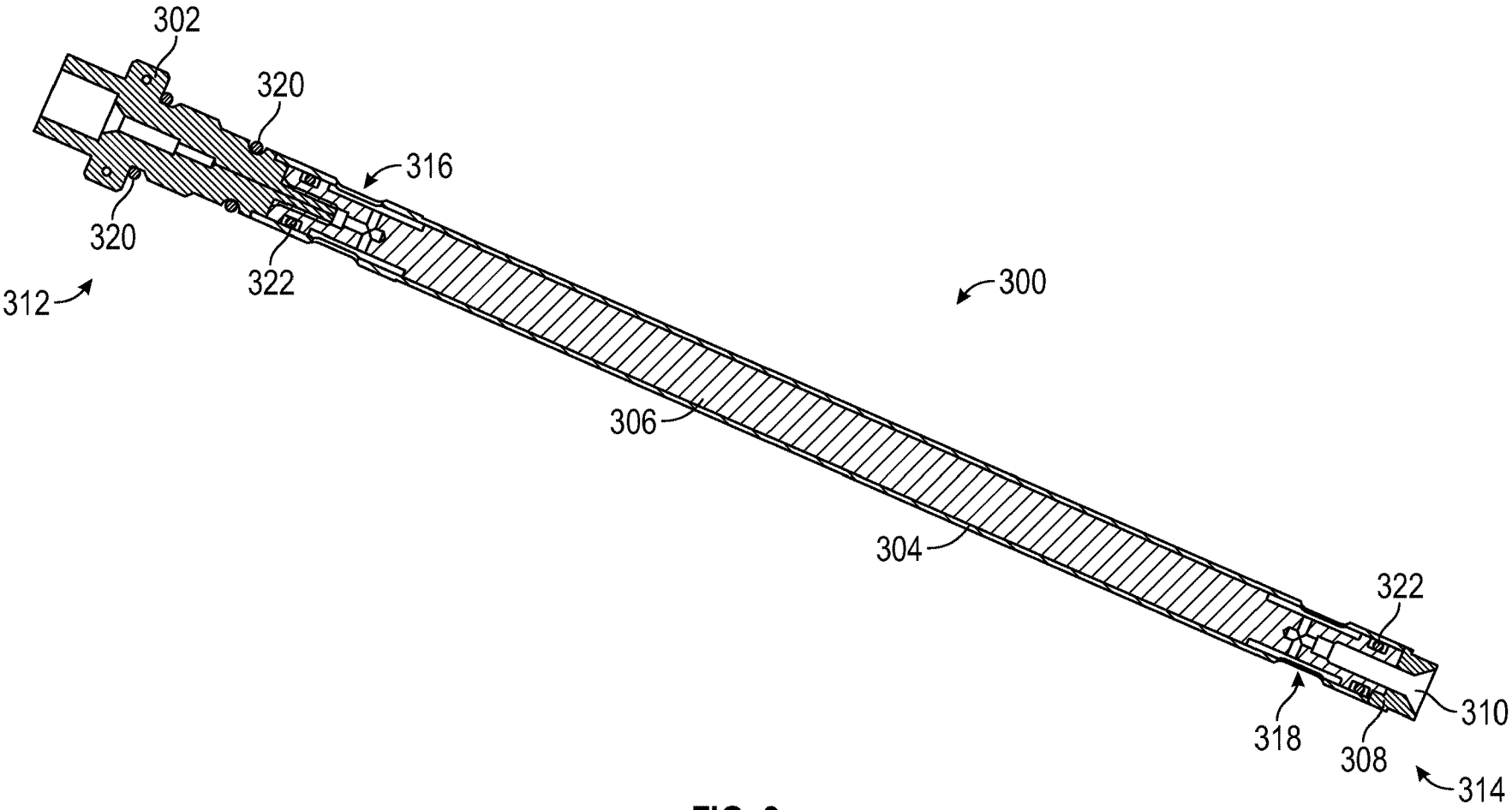
FIG. 3 is a schematic illustration of a serviceable laminar flow element in accordance with an embodiment of the present disclosure.

Turning to FIG. 3, a schematic cross-sectional view of a serviceable laminar flow element 300 in accordance with an embodiment of the present disclosure are shown. The serviceable laminar flow element 300 may be configured to be removably installed into a manifold assembly of a fluid processing system, such as shown and described above. The serviceable laminar flow element 300 includes a mounting plug 302, a flow sleeve 304, a laminar flow rod 306, an index cap 308, and a fastener 310. A flow path is defined between an interior surface of the flow sleeve 304 and an exterior surface of the laminar flow rod 306.

The serviceable laminar flow element 300 extends from a first end 312 to a second end 314. A flow path or flow direction through the serviceable laminar flow element 300 is from the first end 312 to the second end 314. A fluid can enter the flow path through one or more first apertures 316 (e.g., inlets) at the first end 312 and exit the flow path through one or more second apertures 318 (e.g., outlets) at the second end 314.

As shown, a number of seals 320, 322 (e.g., O-rings) are arranged relative to the components of the serviceable laminar flow element 300 to ensure that no exterior contaminates may enter the flow path and that there is no leakage of fluid as it passes through the serviceable laminar flow element 300. As shown, first seals 320 are configured on an exterior of the serviceable laminar flow element 300, and may be configured for forming seals relative to and with respect to a portion of a manifold assembly (e.g., a bore within the manifold assembly). The second seals 322 are configured as internal seals to provide sealing between the various components of the serviceable laminar flow element 300 (e.g., between internal surfaces of the flow sleeve 304 and external surfaces of the laminar flow rod 306).

The mounting plug 302 may be configured to threadedly engage with at least the laminar flow rod 306 at the first end 312. In some configurations, the mounting plug may be configured to also threadedly engage with the flow sleeve 304 at the first end. At the second end 314, the fastener 310 may threadedly engage with, at least, the laminar flow rod 306 and provide for a secure engagement of the index cap 308, the flow sleeve 304, and the laminar flow rod 306. In some configurations, the fastener 310 may threadedly engage with a threaded bore of the index cap 308 as well.

Figure 4A:
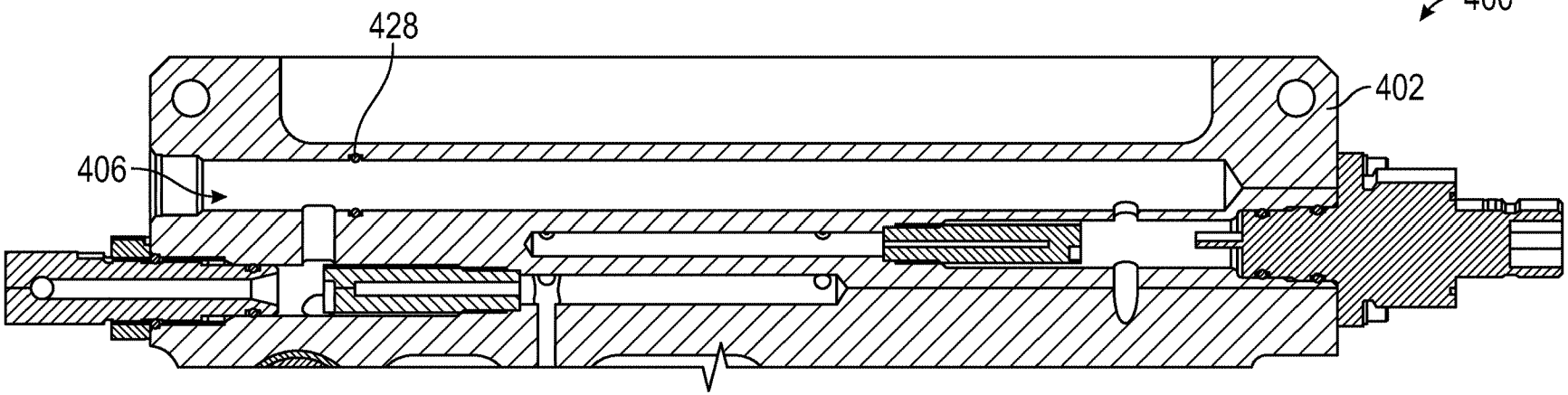
FIG. 4A is a schematic illustration of a manifold assembly in accordance with an embodiment of the present disclosure.
Figure 4B:
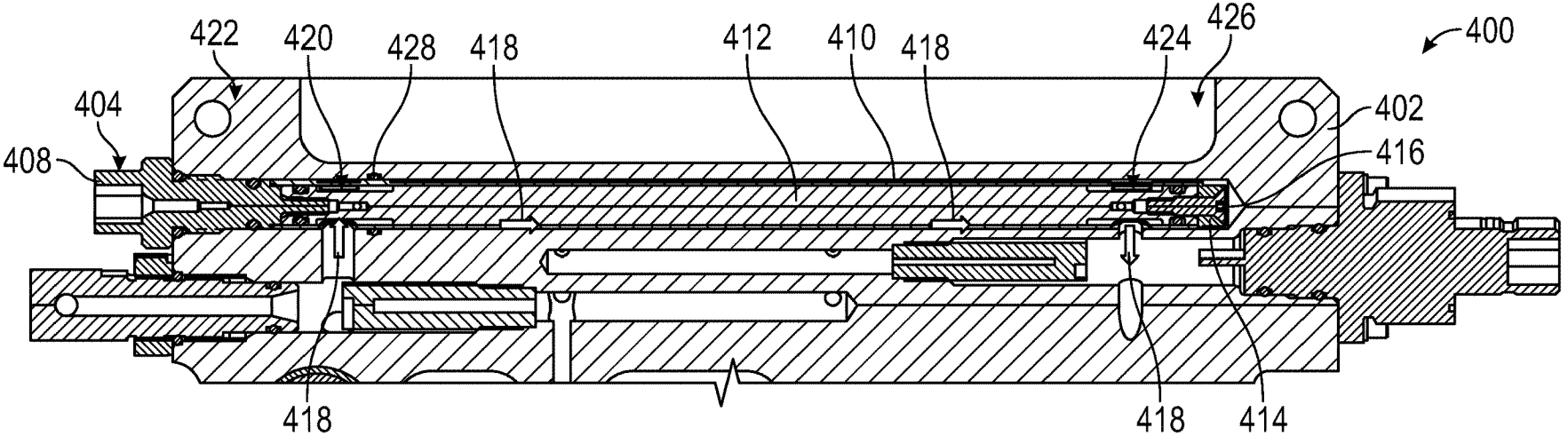
FIG. 4B is a schematic illustration of the manifold assembly of FIG. 4A with a serviceable laminar flow element in accordance with an embodiment of the present disclosure installed therein.

Referring to FIGS. 4A-4B, schematic illustration of a fluid processing system 400 are shown. The fluid processing system 400 includes a manifold assembly 402 and a serviceable laminar flow element 404 that is installable therein. The manifold assembly 402 is configured to receive inputs of gas or other fluids and extract out water or other fluids. That is, the fluid processing system 400 is configured to receive inputs of a first fluid and output a second fluid. For example, the fluid processing system 400 may be used onboard spacecraft for the purpose of extracting water from gas and other fluid inputs. In one or more configurations, the fluid processing system 400 may be configured to convert waste carbon dioxide and hydrogen to provide needed water for a closed-loop life-support system onboard a spacecraft (e.g., Sabatier reaction).

FIG. 4A illustrates the manifold assembly 402 without the serviceable laminar flow element 404 installed therein, and FIG. 4B illustrates the serviceable laminar flow element 404 installed within the manifold assembly 402. As shown in FIG. 4A, the manifold assembly 402 includes a laminar element bore 406. The laminar element bore 406 is sized to receive a serviceable laminar flow element 404 therein.

FIG. 4B shows the serviceable laminar flow element 404 as installed within the laminar element bore 406 of the manifold assembly 402. The serviceable laminar flow element 404 includes a mounting plug 408, a flow sleeve 410, a laminar flow rod 412, an index cap 414, and a fastener 416. When installed, a laminar flow path 418 is defined by the serviceable laminar flow element 404. A fluid can enter the serviceable laminar flow element 404 at one or more first apertures 420 at a first end 422 of the serviceable laminar flow element 404, flow through a gap defined between an interior surface of the flow sleeve 410 and an exterior surface of the laminar flow rod 412, and exit through one or more second apertures 424 at a second end 426 of the serviceable laminar flow element 404.

The serviceable laminar flow element 404 may be fixedly connected to the manifold assembly 402 by a threaded connection between the mounting plug 408 and a threaded portion of the laminar element bore 406 of the manifold assembly 402. As such, the serviceable laminar flow element 404 may be fixedly mounted at the first end 422 of the serviceable laminar flow element 404. At the second end 426 of the serviceable laminar flow element 404, the serviceable laminar flow element 404 may be free (e.g., not fixedly connected to a portion of the manifold assembly 402). In some configurations, the flow sleeve 410 may be sized with an outer diameter to substantially fit within the laminar element bore 406 with no gap or space between (or close to no gap or space between). A mounting seal 428 may be installed within a seal groove of the laminar element bore 406. The mounting seal 428 may be configured to seal against an exterior surface of the flow sleeve 410. In some embodiments, as shown in FIG. 4B, the location of the mounting seal 428 may be downstream along the direction of the laminar flow path 418 from the first apertures 420. The mounting seal 428 may be an overboard flow prevention internal O-ring.

Figure 5:
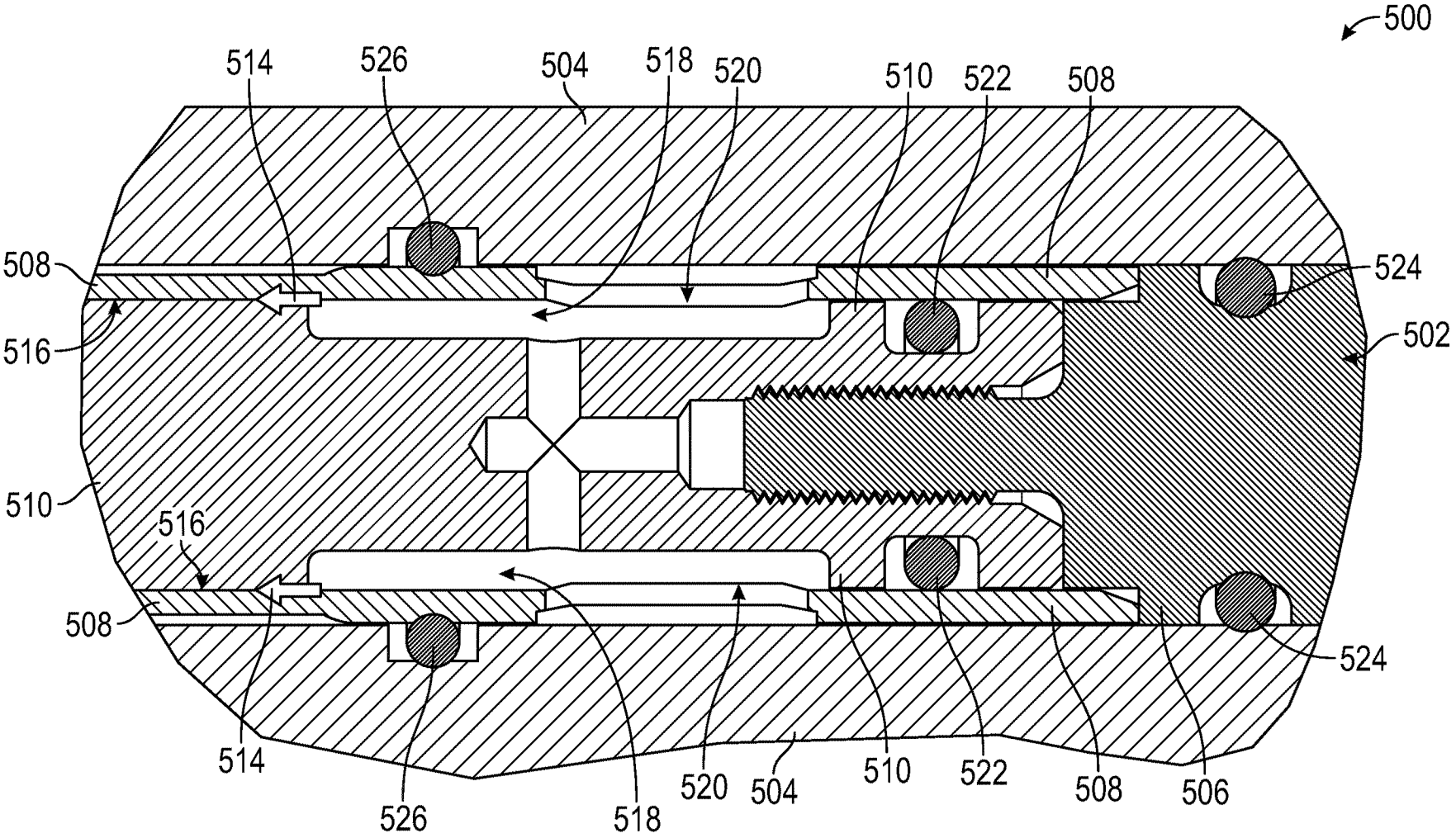
FIG. 5 is a schematic illustration of a portion of a fluid processing system in accordance with an embodiment of the present disclosure.

Turning now to FIG. 5, an enlarged illustration of a portion of a fluid processing system 500 in accordance with an embodiment of the present disclosure is shown. As shown in FIG. 5, a serviceable laminar flow element 502 is installed within a laminar element bore of a manifold assembly 504 of the fluid processing system 500. FIG. 5 is illustrative of a first or inlet side of the serviceable laminar flow element 502. The serviceable laminar flow element 502 includes a mounting plug 506, a flow sleeve 508, and a laminar flow rod 510. The laminar flow rod 510 may be fixedly attached to the flow sleeve by a mounting plug 506 at a first end and an index cap and fastener (not shown) at a second end. Further, the serviceable laminar flow element 502 may be fixedly installed into the manifold assembly 504 by a threaded connection therebetween.

As shown, a laminar flow path 514 is defined by a gap 516 between an interior surface of the flow sleeve 508 and an exterior surface of the laminar flow rod 510. As such, in accordance with embodiments of the present disclosure, the laminar flow path does not pass between a surface of the serviceable laminar flow element 502 and a surface of the manifold assembly 504 (e.g., a surface of a laminar element bore of the manifold assembly 504). Accordingly, the precision manufacturing required for forming, ensuring, and maintaining a laminar fluid flow is only dictated by the interior surface of the flow sleeve 508 and an exterior surface of the laminar flow rod 510, which are removably installed within the manifold assembly 504. This enables the laminar flow components of the system to be removed, replaced, serviced, etc. without requiring an entire new manifold assembly and/or fluid processing system.

As shown, the serviceable laminar flow element 502 defines a first fluid cavity 518 (e.g., an inlet cavity) between the flow sleeve 508 and the laminar flow rod 510. A fluid may enter the first fluid cavity 518 through at least one first aperture 520 of the flow sleeve 508. A fluid within the first fluid cavity 518 will enter the gap 516 and flow toward a second end of the serviceable laminar flow element 502, which may include a similarly arranged second fluid cavity (e.g., an outlet cavity). To ensure the fluid only flows where needed, a first seal 522 is arranged between the flow sleeve 508 and the laminar flow rod 510 upstream from the first fluid cavity 518 relative to the laminar flow path 514. The first seal 522 is configured to prevent the fluid from ingesting between the flow sleeve 508 and the laminar flow rod 510 and leaking from the serviceable laminar flow element 502. A second seal 524 is arranged between the mounting plug 506 and a surface of the manifold assembly 504, again upstream from the first fluid cavity 518 relative to the laminar flow path 514. The second seal 524 ensures a sealing engagement between the manifold assembly 504 and the serviceable laminar flow element 502. A third seal 526 may be a mounting seal that forms a sealing engagement between the manifold assembly 504 and the serviceable laminar flow element 502 downstream from the first aperture 520 relative to the laminar flow path 514.

Turning now to FIGS. 6A-6B, schematic illustrations of a portion of a fluid processing system 600 in accordance with an embodiment of the present disclosure are shown. As shown in FIGS. 6A-6B, a serviceable laminar flow element 602 is installed within a laminar element bore 604 of a manifold assembly 606 of the fluid processing system 600. FIG. 6A illustrates a side elevation cross-sectional view of the fluid processing system 600 and FIG. 6B illustrates a front or axial cross-sectional view of the fluid processing system 600.

The serviceable laminar flow element 602 includes a flow sleeve 608 and a laminar flow rod 610. A laminar flow path is defined within a gap 612 between an interior surface 614 of the flow sleeve 608 and an exterior surface 616 of the laminar flow rod 610. The gap 612 is a high precision gap with a separation distance $G_L$ that is maintained for the length of the laminar flow path from a first end to a second end of the serviceable laminar flow element 602. The separation distance $G_L$ is selected to ensure the generation of a laminar flow of a fluid flowing through the gap 612. A typical range for the separation distance $G_L$ is between about 0.0001 inches to about 0.0010 inches. Specifically, the separation distance $G_L$ is the radial gap or space between the outer diameter (exterior surface 616) of the laminar flow rod 601 and the inner diameter (interior surface 614) of the flow sleeve 608. The range of the separation distance $G_L$ may be, at least partially, dependent on fluid type and environment. The function of a laminar flow element is to create a measurable laminar flow by eliminating flow turbulence. In some non-limiting embodiments, the separation distance $G_L$ may be on the order of 0.0005 inches (e.g., about the size or space for molecular flow). The separation distance $G_L$ is configured to be substantial constant from or between a first end and a second end of a laminar flow path defined by the gap 612. Such constant separation distance $G_L$ ensure the formation of laminar fluid flow.

The serviceable laminar flow element 602 may be a high precision component with the interior surface 614 of the flow sleeve 608 and the exterior surface 616 of the laminar flow rod 610 machined to high precision. However, an exterior surface of the flow sleeve 608 does not require such high precision interface and surface. Because of this, the manifold assembly 606 does not require the same high precision manufacturing as the serviceable laminar flow element 602. Because the serviceable laminar flow element 602 is configured to be removably installed within the manifold assembly 606, if the serviceable laminar flow element 602 becomes compromised in any way, the serviceable laminar flow element 602 may be removed and serviced and/or replaced, without requiring complete rework or replacement of the entire fluid processing system 600.

Turning now to FIGS. 7A-7B, schematic illustrations of a portion of a serviceable laminar flow element 700 are shown. The views of FIGS. 7A-7B illustrate a second end of the serviceable laminar flow element 700 (e.g., proximate an outlet of a laminar flow path). The serviceable laminar flow element 700 includes a flow sleeve 702 with a laminar flow rod 704 installed therein. An index cap 706 is arranged to fixedly attach the laminar flow rod 704 to the flow sleeve 702 by means of a fastener 708. The index cap 706 is configured to lock an orientation of the laminar flow rod 704 to the flow sleeve 702 such that rotational movement between the two elements is prevented. The locking is achieved using a locking protrusion 710 that engages with a locking slot 712 of the flow sleeve 702. The fastener 708 is configured to threadedly engage with a threaded bore of the laminar flow rod 704.

FIG. 7A also illustrates a second fluid cavity 714 defined between a portion of the laminar flow rod 704 and the flow sleeve 702 at a second end of the serviceable laminar flow element 700. The flow sleeve 702 includes one or more apertures 716 at the second end to allow fluid flow to exit the second fluid cavity 714.

In accordance with embodiments of the present disclosure, by having a serviceable laminar flow element, a fluid processing system may be calibrated and serviced without a complete rework of the system. The calibration merely requires calibration and manufacture, at high precision, of the serviceable laminar flow element. The calibrated serviceable laminar flow element can then be installed into a bore of the manifold assembly. Once installed, a mounting plug can be used to torque the serviceable laminar flow element to the manifold assembly. Furthermore, one or more seals can be configured prevent reverse-flow from entering a clearance passage between the flow sleeve and a wall of the bore within the manifold assembly.

Advantageously, embodiments of the present disclosure provide for a serviceable laminar flow element and thus enable replacement, on-orbit, of a laminar flow element of a fluid processing system in case of loss of function (e.g., contamination). In accordance with embodiments described herein, the serviceable laminar flow element incorporates a separate flow sleeve around the laminar flow rod which eliminates the need for a precise bore and calibration to the fluid manifold. The flow sleeve and laminar flow rod also incorporate an angular index feature, provided an index cap, which allows precise bench calibration of characteristics of the serviceable laminar flow element. Seal provisions are provided to allow only flow through a precision gap between an interior surface of the flow sleeve and an exterior surface of the laminar flow rod. A plurality of seals, both interior to the serviceable flow element and between the serviceable flow element and a bore of the manifold, provide for a desired laminar fluid flow while also allowing for a serviceable and replaceable laminar flow element.

Advantageously, embodiments described herein allow for the replacement of a defective laminar flow element in-situ. Furthermore, because the laminar flow element is interchangeable and serviceable, embodiments described herein allow for bench calibration of the laminar flow element for interchangeability. With these two features, a system incorporating a serviceable flow element as described herein can be restored to original operational function without the need to rework the entire system. In accordance with some embodiments, a serviceable laminar flow element may be installed within a fluid processing system and a calibration of parameters of a replacement serviceable laminar flow element can be entered into an operational software of the system to enable restoration to full functionality of the system, after replacement thereof.

As used herein, the terms "about" and "substantially" are intended to include the degree of error associated with measurement of the particular quantity based upon the equipment available at the time of filing the application. For example, the terms may include a range of ±8%, or 5%, or 2% of a given value or other percentage change as will be appreciated by those of skill in the art for the particular measurement and/or dimensions referred to herein.

The terminology used herein is for the purpose of describing particular embodiments only and is not intended to be limiting of the present disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof. It should be appreciated that relative positional terms such as "forward," "aft," "upper," "lower," "above," "below," "radial," "axial," "circumferential," and the like are with reference to normal operational attitude and should not be considered otherwise limiting.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A serviceable laminar flow element comprising:
- a flow sleeve;
- a laminar flow rod installed within the flow sleeve;
- a mounting plug arranged at a first end of the flow sleeve configured to fixedly secure the laminar flow rod within the flow sleeve at the first end; and
- an index cap arranged at a second end of the flow sleeve configured to fixedly secure the laminar flow rod within the flow sleeve at the second end,
- wherein a laminar flow path is defined by a gap between an interior surface of the flow sleeve and an exterior surface of the laminar flow rod.

2. The serviceable laminar flow element of claim 1, further comprising a fastener configured to securely attach the index cap to the laminar flow rod.

3. The serviceable laminar flow element of claim 1, wherein the index cap comprises a locking protrusion configured to engage with a locking slot of the flow sleeve such that relative rotation between the flow sleeve and the laminar flow rod is prevented.

4. The serviceable laminar flow element of claim 1, wherein the gap is between about 0.0001 inches to about 0.0010 inches.

5. The serviceable laminar flow element of claim 1, wherein the gap is about 0.0005 inches.

6. The serviceable laminar flow element of claim 1, wherein the flow sleeve comprises at least one first aperture at the first end to receive a fluid therethrough and at least one second aperture at the second end to allow a fluid to pass therethrough.

7. The serviceable laminar flow element of claim 1, further comprising at least one seal configured to sealingly engage between the interior surface of the flow sleeve and the exterior surface of the laminar flow rod.

8. The serviceable laminar flow element of claim 1, wherein the gap is substantially constant along the laminar flow path.

9. A fluid processing system comprising:
- a manifold assembly defining a laminar element bore; and
- a serviceable laminar flow element installed within the laminar element bore, wherein the serviceable laminar flow element comprises:

a flow sleeve;

a laminar flow rod installed within the flow sleeve;

a mounting plug arranged at a first end of the flow sleeve configured to fixedly secure the laminar flow rod within the flow sleeve at the first end; and an index cap arranged at a second end of the flow sleeve configured to fixedly secure the laminar flow rod within the flow sleeve at the second end, wherein a laminar flow path is defined by a gap between an interior surface of the flow sleeve and an exterior surface of the laminar flow rod.

10. The fluid processing system of claim 9, further comprising a fastener configured to securely attach the index cap to the laminar flow rod.

11. The fluid processing system of claim 9, wherein the index cap comprises a locking protrusion configured to engage with a locking slot of the flow sleeve such that relative rotation between the flow sleeve and the laminar flow rod is prevented.

12. The fluid processing system of claim 9, wherein the gap is between about 0.0001 inches to about 0.0010 inches.

13. The fluid processing system of claim 9, wherein the gap is about 0.0005 inches.

14. The fluid processing system of claim 9, wherein the flow sleeve comprises at least one first aperture at the first end to receive a fluid therethrough and at least one second aperture at the second end to allow a fluid to pass therethrough.

15. The fluid processing system of claim 9, further comprising at least one seal configured to sealingly engage between the interior surface of the flow sleeve and the exterior surface of the laminar flow rod.

16. The fluid processing system of claim 9, wherein the gap is substantially constant along the laminar flow path.

17. The fluid processing system of claim 9, wherein the fluid processing system is configured to generate water from carbon dioxide and hydrogen.

18. The fluid processing system of claim 9, further comprising a mounting seal arranged along the laminar element bore and configured to form a seal between the laminar element bore and an exterior surface of the flow sleeve.

19. The fluid processing system of claim 9, wherein the mounting plug is configured to fixedly attach the serviceable laminar flow element to the manifold assembly.

* * * * *